US009598656B2

(12) United States Patent
Takahashi et al.

(10) Patent No.: US 9,598,656 B2
(45) Date of Patent: Mar. 21, 2017

(54) METHOD FOR PRODUCING MOLDED SOLID FUEL

(71) Applicant: KABUSHIKI KAISHA KOBE SEIKO SHO (KOBE STEEL, LTD.), Kobe-shi (JP)

(72) Inventors: Yoichi Takahashi, Takasago (JP); Kazuhiro Kouno, Kobe (JP); Tomokazu Nakagawa, Kobe (JP); Takuo Shigehisa, Takasago (JP); Tsuyoshi Adachi, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 19 days.

(21) Appl. No.: 14/768,652

(22) PCT Filed: Mar. 31, 2014

(86) PCT No.: PCT/JP2014/059594
§ 371 (c)(1),
(2) Date: Aug. 18, 2015

(87) PCT Pub. No.: WO2014/175015
PCT Pub. Date: Oct. 30, 2014

(65) Prior Publication Data

US 2016/0002552 A1 Jan. 7, 2016

(30) Foreign Application Priority Data

Apr. 24, 2013 (JP) ..... 2013-091395

(51) Int. Cl.
*C10L 5/00* (2006.01)
*C10L 5/02* (2006.01)
(Continued)

(52) U.S. Cl.
CPC *C10L 5/08* (2013.01); *C10L 5/04* (2013.01); *C10L 5/361* (2013.01); *C10L 9/08* (2013.01);
(Continued)

(58) Field of Classification Search
CPC .... C10L 5/04; C10L 9/08; C10L 5/361; C10L 2290/32; C10L 2290/10;
(Continued)

(56) References Cited

U.S. PATENT DOCUMENTS 8,075,643 B2 * 12/2011 Sugita ..... C10L 9/10 44/621
2012/0011766 A1 1/2012 Yamamoto et al.
2012/0291342 A1 11/2012 Sugita et al.

FOREIGN PATENT DOCUMENTS

GB 616 857 A 1/1949
JP 07-245209 A 9/1995
(Continued)

OTHER PUBLICATIONS

Study of the Flow ability of Pulverized Coals Energy Fuels (2009) 23, 5529-5535 by H Lu, X Guo, X Gong, W Huang, S Ma and C Wa.*
(Continued)

*Primary Examiner* — Pamela H Weiss
(74) *Attorney, Agent, or Firm* — Oblon, McClelland, Maier & Neustadt, L.L.P.

(57) ABSTRACT

A method for producing a briquetted solid fuel includes pulverizing a low-rank coal. The pulverized low-rank coal is mixed with a solvent oil to give a slurry. The slurry is heated and dewatered to give a dewatered slurry. The solvent oil is separated from the dewatered slurry to give a cake. The cake is heated to further separate the solvent oil from the cake to thereby give a refined coal in powder form. The refined coal is combined with a property-controlling coal in powder form having, as properties, a loose bulk density of 0.6 kg/L or more and an angle of repose of 40° or less, to give a briquetting feedstock containing the property-controlling coal in an amount of 5 to 70 mass percent based on the total
(Continued)

mass of the briquetting feedstock. The briquetting feedstock is briquetted under pressure to give the briquetted solid fuel in briquette form.

5 Claims, 1 Drawing Sheet

(51) Int. Cl.

| | |
|---|---|
| ***C10L 5/06*** | (2006.01) |
| ***C10L 5/08*** | (2006.01) |
| ***C10L 5/36*** | (2006.01) |
| ***C10L 9/08*** | (2006.01) |
| ***C10L 5/04*** | (2006.01) |

(52) U.S. Cl.
CPC ..... *C10L 2250/06* (2013.01); *C10L 2290/06* (2013.01); *C10L 2290/08* (2013.01); *C10L 2290/10* (2013.01); *C10L 2290/24* (2013.01); *C10L 2290/28* (2013.01); *C10L 2290/30* (2013.01); *C10L 2290/32* (2013.01); *C10L 2290/54* (2013.01); *C10L 2290/58* (2013.01)

(58) Field of Classification Search
CPC ..... C10L 2290/54; C10L 2290/28; C10L 2290/58; C10L 2290/06; C10L 2290/08; C10L 2250/06; C10L 2290/30; C10L 2290/24
USPC ..... 44/503, 504, 505, 550, 592, 595, 596
See application file for complete search history.

(56) References Cited

FOREIGN PATENT DOCUMENTS

| | | | |
|---|---|---|---|
| JP | 2010-116544 | A | 5/2010 |
| JP | 2012-219140 | A | 11/2012 |
| WO | WO 99/32586 | A1 | 7/1999 |
| WO | 2010/041572 | A1 | 4/2010 |
| WO | 2010/044376 | A1 | 4/2010 |

OTHER PUBLICATIONS

Xu Zhengang, et al., "briquette technology", Coal industry press, the first edition, Nov. 2001, pp. 161, 164, 176-179, 185-186 and Cover Pages (with a partial English translation of Chinese Office Action issued on Jun. 28, 2016 as Concise Explanation).
International Search Report and Written Opinion issued on Jun. 24, 2014 for PCT/JP2014/059594 filed on Mar. 31, 2014.
Extended European Search Report issued Dec. 6, 2016 in Patent Application No. 14787723.7.
Wei Wang, et al., "Experimental study on the angle of repose of pulverized coal", Particuology, vol. 8, No. 5, Oct. 2010, pp. 482-485, XP027423255.

* cited by examiner

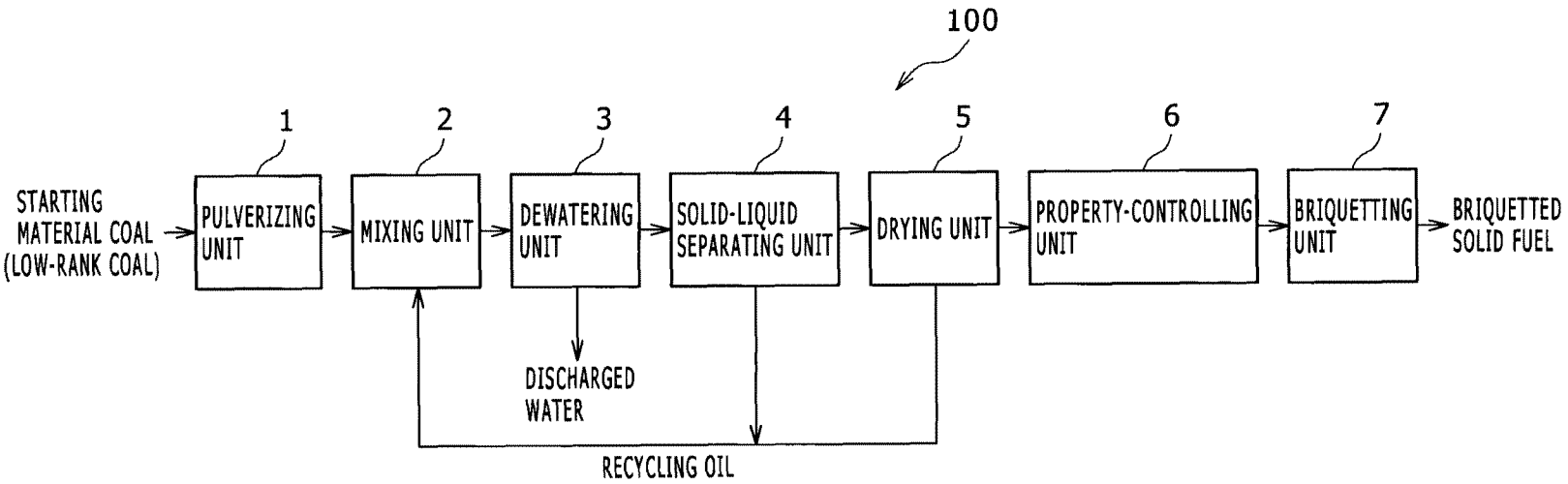
100
STARTING MATERIAL COAL (LOW-RANK COAL)
1
PULVERIZING UNIT
2
MIXING UNIT
3
DEWATERING UNIT
DISCHARGED WATER
4
SOLID-LIQUID SEPARATING UNIT
5
DRYING UNIT
RECYCLING OIL
6
PROPERTY-CONTROLLING UNIT
7
BRIQUETTING UNIT
BRIQUETTED SOLID FUEL

METHOD FOR PRODUCING MOLDED SOLID FUEL

TECHNICAL FIELD

The present invention relates to a method for producing a briquetted solid fuel (molded solid fuel), where the method uses a low-rank coal such as lignite or subbituminous coal as a starting material.

BACKGROUND ART

Low-rank coals such as lignite and subbituminous coal occupy half of the world's coal resources. It is expected to refine or improve such low-rank coals having a moisture content of about 25 to about 65 mass percent and to use them as refined coals having high caloric values. In principle, the low-rank coals are refined by placing the low-rank coal in a heated oil, and evaporating water from the low-rank coal (dewatering).

The present applicant has proposed a method for producing a briquetted solid fuel using a low-rank coal as a starting material in Patent Literature (PTL) 1.

The method for producing a briquetted solid fuel described in PTL 1 includes steps as follows. Initially, a low-rank coal is pulverized to give a pulverized coal in powder form (pulverizing step). The pulverized coal is mixed with a mixed oil containing a heavy oil and a solvent oil to give a slurry (mixing step). The slurry is heated and thereby dewatered to give a dewatered slurry (dewatering step). The solvent oil is separated from the dewatered slurry to give a cake (solid-liquid separating step). The cake is heated to further separate the solvent oil from the cake to thereby give a refined coal in powder form (drying step). The refined coal is combined with the pulverized coal as a moisture source to moisturize the refined coal to give a moisturized refined coal having a moisture content of 3 to 10 mass percent, where the moisturized refined coal is a mixture of the refined coal in powder form and the pulverized coal (moistening step). The moisturized refined coal is briquetted under pressure using a double-roll briquetter to give a briquetted solid fuel, where the double-roll briquetter is equipped with a multiplicity of pockets (concave briquetting molds) on the roll surfaces (briquetting step).

According to the method for producing a briquetted solid fuel described in PTL 1, the refined coal after the drying step is moisturized to give a moisturized refined coal having a moisture content of 3 to 10 mass percent, and the moisturized refined coal is briquetted under pressure. The presence of the moisture allows coal particles to be bonded with each other more firmly. This enables briquetting that gives a briquetted solid fuel having a high strength without using a binder such as starch. Accordingly, the method for producing a briquetted solid fuel described in PTL 1 enables briquetting cost reduction while allowing the briquetted solid fuel to have a strength maintained at satisfactory level.

CITATION LIST

Patent Literature

PTL 1: Japanese Unexamined Patent Application Publication (JP-A) No. 2010-116544

SUMMARY OF INVENTION

Technical Problem

However, the method for producing a briquetted solid fuel described in PTL 1 is still susceptible to improvements so as to provide better productivity, as described below.

When the material to be briquetted (briquetting feedstock) is briquetted using the double-roll briquetter in the briquetting step, the properties of the briquetting feedstock to be fed to the roll pockets from above affect the productivity of the briquetted solid fuel.

The refined coal in powder form obtained in the drying step generally includes fine powder of a size of about 0.2 mm, has an indefinite particle shape, suffers from high friction between particles, and has poor fluidity or flowability.

The refined coal, when used as the briquetting feedstock and briquetted using the double-roll briquetter, is charged with a high porosity into the pockets. To obtain a briquetted solid fuel having a high strength, the briquetting should be performed for a longer time so as to accelerate deaeration, resulting in inferior productivity. The briquetting, if performed for a shorter time to avoid productivity deterioration, fails to allow deaeration to proceed and fails to allow the resulting briquetted solid fuel to have a high strength, because the briquetted solid fuel does not have a sufficiently high density.

Accordingly, the present invention has an object to provide a method for producing a briquetted solid fuel by preparing a refined coal in powder form from a low-rank coal as a starting material, and briquetting the refined coal under pressure to give the briquetted solid fuel, where the method can produce such briquetted solid fuel having a high strength with good productivity.

Solution to Problem

To achieve the object, the present invention provides technological means as follows.

The present invention provides, according to one aspect, a method for producing a briquetted solid fuel, where the method includes the steps of pulverizing, mixing, dewatering, liquid-solid separating, drying, property-controlling, and briquetting. A low-rank coal is pulverized in the pulverizing step. The pulverized low-rank coal is mixed with a solvent oil to give a slurry in the mixing step. The slurry is heated and thereby dewatered to give a dewatered slurry in the dewatering step. The solvent oil is separated from the dewatered slurry by liquid-solid separation to give a cake in the liquid-solid separating step. The cake is heated and thereby dried to further separate the solvent from the cake to thereby give a refined coal in powder form in the drying step. The refined coal is blended with a property-controlling coal in powder form to give a briquetting feedstock in the property-controlling step, where the briquetting feedstock contains the property-controlling coal in an amount of 5 to 70 mass percent based on the total mass of the briquetting feedstock, and the property-controlling coal has, as properties, a loose bulk density of 0.6 kg/L or more and an angle of repose of 40° or less. The briquetting feedstock is briquetted under pressure to give the briquetted solid fuel in briquette form in the briquetting step.

In the method for producing a briquetted solid fuel according to the aspect of the present invention, the property-controlling coal may further have, as properties, an average particle size of 0.3 to 2.0 mm and such a particle size distribution that the percentage of particles each having a particle size of 2 mm or more is 5 to 50 mass percent based on the total mass of the property-controlling coal.

In the method for producing a briquetted solid fuel according to the aspect of the present invention, the property-controlling coal may include at least one selected from the group consisting of a coal prepared by controlling the particle size of the low-rank coal, a coal prepared by pulverizing the low-rank coal and granulating the pulverized low-rank-coal, and a coal prepared by briquetting the refined coal under pressure to give a briquetted coal, pulverizing the briquetted coal to give a pulverized coal, and controlling the particle size of the pulverized coal.

In the method for producing a briquetted solid fuel according to the aspect of the present invention, the property-controlling step may include adding at least one of water and a moistening coal to the briquetting feedstock so that the briquetted solid fuel after briquetting has a moisture content of from 3 to 10 mass percent.

Advantageous Effects of Invention

In the method for producing a briquetted solid fuel according to the present invention, the refined coal in powder form is combined with a predetermined mass percent of a property-controlling coal in powder form to give a mixture as a briquetting feedstock in the property-controlling step. The property-controlling coal has, as properties, a higher loose bulk density and a smaller angle of repose as compared with the refined coal. Specifically, the property-controlling coal includes coarse particles as compared with the refined coal. The resulting briquetting feedstock thereby has lower friction among the particles and better fluidity as compared with a briquetting feedstock including the refined coal in powder form alone.

The briquetting feedstock, when subjected to briquetting using a double-roll briquetter in the briquetting step, can be loaded densely with a low porosity into the pockets. The method for producing a briquetted solid fuel according to the present invention thereby enables production of a briquetted solid fuel having a high strength with good productivity.

BRIEF DESCRIPTION OF DRAWINGS

FIG. 1 is a block diagram illustrating the overall configuration of equipment for producing a briquetted solid fuel for use in the production method according to the present invention.

DESCRIPTION OF EMBODIMENTS

The present invention including some embodiments will be illustrated in further detail below.

One of features of the present invention is that, in the property-controlling step, the refined coal in powder form is blended with a property-controlling coal in powder form to give a briquetting feedstock containing the property-controlling coal in a percentage of 5 to 70 mass percent based on the total mass of the briquetting feedstock, where the property-controlling coal has, as properties, a loose bulk density of 0.6 kg/L or more and an angle of repose of 40° or less.

The property-controlling coal may be prepared from any starting material not limited, but may be prepared from the low-rank coal as used in the pulverizing step, or the refined coal obtained in the drying step.

The property-controlling coal is a powdery coal having, as properties, (a) a loose bulk density of 0.6 kg/L or more and (b) an angle of repose of 40° or less. Specifically, the property-controlling coal includes coarse particles as compared with the refined coal in powder form obtained in the drying step.

The property-controlling coal has the properties (a) and (b). The resulting briquetting feedstock containing the property-controlling coal in a percentage of 5 to 70 mass percent based on the total mass of the briquetting feedstock has lower friction among particles and has better fluidity as compared with a briquetting feedstock including the refined coal alone. The briquetting feedstock, when subjected to briquetting using a double-roll briquetter in the briquetting step, can be loaded densely with a low porosity in the pockets. The method for producing a briquetted solid fuel according to the present invention thereby enables production of a briquetted solid fuel having a high strength with good productivity.

The property-controlling coal, if present in a percentage less than 5 mass percent, may fail to sufficiently effectively contribute to better productivity. Independently, the property-controlling coal includes coarse particles as compared with the refined coal. The property-controlling coal, if present in a percentage greater than 70 mass percent, may have saturated effects of reducing the porosity. In addition, this property-controlling coal may cause the briquetted solid fuel to be susceptible to cracking, because coarse particles constituting the property-controlling coal may act as cracking origins, where the "cracking" herein refers to a phenomenon in which the solid fuel is cracked. The property-controlling coal in this case may fail to give a briquetted solid fuel having a high strength because it fails to efficiently impart a strength to the briquetted solid fuel. To prevent this, the property-controlling coal may be contained (blended) in a percentage of appropriately from 5 to 70 mass percent based on the total mass of the briquetting feedstock.

The property-controlling coal more preferably further has, as properties, (c) an average particle size of 0.3 to 2.0 mm and (d) such a particle size distribution that the percentage of particles each having a particle size of 2 mm or more is 5 to 50 mass percent based on the total mass of the property-controlling coal.

The property-controlling coal, if including particles having an average particle size $D_{50}$ less than 0.3 mm, may include a large amount of fine particles and may thereby have a higher porosity. This may cause the briquetting feedstock to have a lower loose bulk density and may fail to sufficiently effectively have a high strength with better productivity. In contrast, the property-controlling coal, if including particles having an average particle size $D_{50}$ greater than 2.0 mm, may include a large amount of coarse particles. This may cause the briquetted solid fuel to be susceptible to cracking from the coarse particles as origins and to fail to effectively have a high strength. To prevent these, the property-controlling coal may appropriately have an average particle size $D_{50}$ of from 0.3 to 2.0 mm.

The property-controlling coal, if having a percentage $W_{2.0}$ less than 5 mass percent, may cause the briquetting feedstock to have a lower loose bulk density and may fail to sufficiently effectively have a high strength with better productivity. The percentage $W_{2.0}$ refers to the percentage of particles each having a particle size of 2 mm or more based on the total mass of the property-controlling coal. In contrast, the property-controlling coal, if having a percentage $W_{2.0}$ greater than 50 mass percent, may cause the briquetted solid fuel to be susceptible to cracking and to fail to effectively have a high strength. To prevent these, the percentage $W_{2.0}$ may be appropriately controlled within the range of 5 to 50 mass percent.

In a preferred embodiment, at least one of water and a moistening coal (coal for moistening) in powder form may be added to the briquetting feedstock in the property-controlling step so that the briquetted solid fuel after briquetting has a moisture content of from 3 to 10 mass percent. The addition of water (moisture source) in a predetermined amount may impart a strength to the resulting briquetted solid fuel. This is because the water acts as a binder upon briquetting of the briquetting feedstock into the solid fuel. Furthermore, the addition of water may accelerate the deaeration and may allow the briquetting feedstock to be loaded densely with a low porosity into the pockets of the double-roll briquetter, thus effectively offering better productivity.

The briquetted solid fuel after briquetting, if having a moisture content less than 3 mass percent, may have a lower strength contrarily, because of abrupt moisture absorption after briquetting. In contrast, the briquetted solid fuel after briquetting, if having a moisture content greater than 10 mass percent, may have significantly inferior value as a fuel, may receive an excessively large load upon briquetting, and may suffer from inferior productivity contrarily. To prevent these, the briquetting feedstock is preferably combined with at least one of water and the moistening coal in powder form so that the briquetted solid fuel after briquetting has a moisture content within the range of 3 to 10 mass percent.

FIG. 1 is a block diagram illustrating briquetted solid fuel production equipment for use in the production method according to the present invention.

As illustrated in FIG. 1, the briquetted solid fuel production equipment 100 includes a pulverizing unit 1, a mixing unit 2, a dewatering unit 3, a solid-liquid separating unit 4, a drying unit 5, a property-controlling unit 6, and a briquetting unit 7. A low-rank coal (starting material coal) is pulverized in the pulverizing unit 1. The pulverized low-rank coal is mixed with a solvent oil to give a slurry in the mixing unit 2. The slurry is heated and thereby dewatered to give a dewatered slurry in the dewatering unit 3. The solvent oil is separated from the dewatered slurry to give a cake in the solid-liquid separating unit 4. The cake is heated to further separate the solvent oil from the cake to thereby give a refined coal in powder form in the drying unit 5. A property-controlling coal in powder form having predetermined properties is prepared and is blended with the refined coal to give a briquetting feedstock containing the property-controlling coal in a predetermined percentage in the property-controlling unit 6. The briquetting feedstock is briquetted under pressure to give a briquetted solid fuel in briquette form in the briquetting unit 7. The method for producing a briquetted solid fuel according to the embodiment using the production equipment 100 will be described below.

Pulverizing Step

Initially, a low-rank coal (starting material coal) is fed to and pulverized in the pulverizing unit 1. The pulverizing unit 1 includes a pulverizer. The low-rank coal is exemplified by lignite and subbituminous coal.

Mixing Step

Next, the pulverized low-rank coal is mixed with a solvent oil in the mixing unit 2 to give a slurry as a mixture having fluidity, where the mixture contains the pulverized low-rank coal and the solvent oil. The mixing unit 2 includes, for example, a mixing tank that mixes the low-rank coal with the solvent oil; and an agitator disposed in the mixing tank. The solvent oil and the pulverized low-rank coal may be mixed so that the mass ratio between them is typically about 1.7 on dry water-free coal basis. The solvent oil acting as a heat-transfer medium for dewatering is exemplified by kerosene, light oil, and heavy oil.

Dewatering Step

Next, the slurry obtained in the mixing unit 2 is heated and thereby dewatered in the dewatering unit 3 to give a dewatered slurry. The dewatering unit 3 includes, for example, a preheater that preheats the slurry obtained in the mixing unit 2; and an evaporator that rises the temperature of the preheated slurry. In the evaporator, "dewatering in oil" is performed under pressurized and heated conditions at a pressure of 0.2 MPa to 0.5 MPa and a temperature of 120° C. to 160° C. The evaporator discharges water contained in the low-rank coal in the slurry as discharged water.

Solid Separating Step

Next, the solvent oil is separated from the dewatered slurry in the solid-liquid separating unit 4 to give a muddy cake. The solid-liquid separating unit 4 includes a solid-liquid separator. The solid-liquid separator for use herein is exemplified by a centrifuge that separates the dewatered slurry into the cake and the solvent oil by centrifugal separation. The solvent oil separated and recovered from the dewatered slurry is returned as a recycling oil to the mixing unit 2. The solvent oil returned to the mixing unit 2 is reused to prepare the slurry in the mixing unit 2.

Drying Step

Next, the cake separated in the solid-liquid separating unit 4 is heated in the drying unit 5 to separate the solvent oil from the cake to thereby give a refined coal in powder form. The solvent oil separated and recovered from the cake is returned as a recycling oil to the mixing unit 2. The drying unit 5 includes, for example, a dryer and a gas cooler. The dryer for use herein is exemplified by a steam tube dryer that includes a drum, and a plurality of heating steam tubes axially disposed on an inner surface of the drum. The cake is heated in the dryer to evaporate the solvent oil therefrom. The evaporated solvent oil is transferred by a carrier gas from the dryer to the gas cooler. The solvent oil transferred to the gas cooler is condensed, recovered, and returned as a recycling oil to the mixing unit 2.

The refined coal in powder form obtained in the drying unit 5 generally has, as properties, a loose bulk density P of 0.5 kg/L, an angle of repose A of 50°, an average grain size $D_{50}$ of 0.1 mm, and a moisture content of 0 to 2 mass percent. This refined coal in powder form generally includes a "fluffy" fine powder.

Property-Controlling Step

In the property-controlling unit 6, a property-controlling coal in powder form having predetermined properties is prepared and blended in a predetermined percentage with the refined coal obtained in the drying unit 5 to give a briquetting feedstock. The property-controlling coal is a powdery/granular coal having, as properties, (a) a loose bulk density of 0.6 kg/L or more and (b) an angle of repose of 40° or less. In a more preferred embodiment, the property-controlling coal may further have, as properties, (c) an average particle size of 0.3 to 2.0 mm and (d) such a particle size distribution that the percentage of particles each having a particle size of 2 mm is 5 to 50 mass percent based on the total mass of the property-controlling coal.

The briquetting feedstock includes the refined coal and 5 to 70 mass percent of the property-controlling coal based on the total mass of the briquetting feedstock. A starting material used to prepare the property-controlling coal may be selected from the low-rank coal as used in the pulverizing step (starting material for the refined coal); and the refined coal obtained in the drying step.

When the low-rank coal is used as the starting material for the property-controlling coal, the property-controlling unit 6 may include a classifier; or include both a pulverizer and a granulator. The classifier classifies the low-rank coal and is exemplified by a sieve and a cyclone. The pulverizer pulverizes the low-rank coal and is exemplified by a pin mill and a hammer mill. The granulator agitates and granulates the pulverized low-rank coal while adding a small amount (1 to 2 mass percent) of water to the pulverized low-rank coal and is exemplified by a Henschel mixer. The property-controlling coal may be prepared using any of these apparatuses.

When the refined coal is used as the starting material for the property-controlling coal, the property-controlling unit 6 may typically include a double-roll briquetter, a pulverizer, and a sieve classifier. The double-roll briquetter briquettes, under pressure, the refined coal in powder form obtained in the drying unit 5 to give a briquetted coal. The pulverizer pulverizes the briquetted coal to give a pulverized coal. The sieve classifier classifies the pulverized coal. The property-controlling coal may be prepared using these apparatuses.

In an embodiment, the briquetting feedstock may be combined with at least one of water and a moistening coal in the property-controlling unit 6, so that the briquetted solid fuel after briquetting has a moisture content of from 3 to 10 mass percent. The moistening coal usable herein is exemplified by pulverized undried starting material coal (raw coal).

Briquetting Step

Next, the briquetting feedstock obtained in the property-controlling unit 6 is briquetted under pressure in the briquetting unit 7 to give a briquetted solid fuel in briquette form. The briquetting unit 7 may include a double-roll briquetter. The double-roll briquetter structurally includes two cylindrical rolls disposed horizontally adjacent to each other, in which the rolls are configured to rotate in a direction from above toward the adjacent point between the two rolls. The two rolls include a multiplicity of pockets (molds) in outer peripheral surfaces. The pockets each have an almond-like shape and act as a briquetting mold for oval briquettes.

Example

Next, the present invention will be illustrated in further detail with reference to several examples together with comparative examples.

The steps in the pulverizing unit 1, mixing unit 2, solid-liquid separating unit 4, and drying unit 5 were performed and thereby yielded a refined coal in powder form. The starting material low-rank coal used herein was Mulia coal as Indonesian lignite. The refined coal had, as properties, a loose bulk density P of 0.5 kg/L, an angle of repose A of 50°, an average particle size $D_{50}$ of 0.1 mm, and a particle size distribution $W_{2.0}$ of 1.5 mass percent. The refined coal had a moisture content of about 0 mass percent.

Examples 1 to 5 will be described with reference to Table 1.

Using the low-rank coal or the refined coal as the starting material for property-controlling coals, property-controlling coals having properties as given in items (3) to (6) for the examples in Table 1 were prepared in Examples 1 to 5. The property-controlling coals obtained in Examples 1 to 5 underwent classification through a sieve having an opening of 10 mm and had a maximum particle size less than 10 mm.

Example 1 employed the low-rank coal as the property-controlling coal starting material, in which the low-rank coal was pulverized, the pulverized low-rank coal was agitated and granulated, and thereby yielded the property-controlling coal. Examples 2 to 5 employed the refined coal as the property-controlling coal starting material, in which the refined coal was briquetted under pressure to give a briquetted coal, the briquetted coal after briquetting under pressure was pulverized, the resulting pulverized coal was classified for particle size control, and thereby yielded the property-controlling coals.

The property-controlling coals were examined to measure a loose bulk density P and an angle of repose A using powder property evaluation equipment "Powder Characteristics Tester PT-S" supplied by Hosokawa Micron Corporation. The property-controlling coals were also examined to measure a particle size distribution $W_{2.0}$ by the method prescribed in Japanese Industrial Standard (JIS) using a metal sieve. When the low-rank coal was used as the property-controlling coal starting material, the particle size distribution $W_{2.0}$ was measured after drying the property-controlling coal at 107° C. for 2 hours so as to remove adherent moisture.

In Examples 1 to 5, each of the property-controlling coals was blended with the refined coal and thereby yielded a briquetting feedstock containing the property-controlling coal in a percentage based on the total mass of the briquetting feedstock, as given in item (2) for the examples in Table 1.

In addition, a treatment was performed as indicated in items (7) and (8) in Table 1. Specifically, the briquetting feedstock in Example 1 was further combined with a moistening coal in powder form (having a moisture content of 50 mass percent) in an amount of 8.0 mass percent based on the total mass of the resulting briquetting feedstock including the moistening coal, The briquetting feedstocks in Examples 2 to 4 were each further combined with water for moistening in an amount of 6.0 mass percent based on the total mass of the resulting briquetting feedstock including the water. The briquetting feedstock in Example 5 was not combined with water.

Next, in Example 1, the briquetting feedstock added and mixed with the moistening coal was briquetted under pressure using a double-roll briquetter and yielded a briquetted solid fuel in briquette form. In Examples 2 to 4, the briquetting feedstocks added and mixed with the water for moistening were briquetted under pressure using the double-roll briquetter and yielded briquetted solid fuels in briquette form. In Example 5, the briquetting feedstock not added with water for moistening was briquetted under pressure using the double-roll briquetter and yielded a briquetted solid fuel in briquette form. The double-roll briquetter used herein included rolls with a diameter of 520 mm, where the rolls included a multiplicity of pockets (concavities) disposed in two rows. The pockets each had a size of 38 by 38 by 20 mm.

The briquetted solid fuels in Examples 1 to 5 were prepared each at two or more different numbers of revolutions of the double-roll briquetter rolls. The briquetted solid fuels obtained at the different numbers of revolutions were individually examined to measure a crushing strength and a moisture content. Based on the measured crushing strengths, a critical production rate (production amount) at which the solid fuel could maintain its high strength was defined as a "production rate at high strength". The production rate at high strength, the crushing strength at that production rate, and the moisture content of the briquetted solid fuels are indicated in items (x) to (z) for the examples in Table 1. The crushing strengths of the briquetted solid fuels were measured with a crushing strength measurement apparatus supplied by Furukawa Industrial Machinery Systems Co., Ltd. The moisture contents of the briquetted solid fuels were measured by the heating method as prescribed in Japanese Industrial Standard (JIS) at 107° C. for a heating time of 2 hours.

Next, Comparative Examples 1 to 4 will be described with reference to Table 2.

Comparative Example 1 employed, as a property-controlling coal, a pulverized low-rank coal as intact without property control. The property-controlling coal had properties as given in items (3) to (6) for Comparative Example 1 in Table 2. Comparative Example 2 employed, as a property-controlling coal, a refined coal as intact without property control, where the refined coal differed from, but had properties close to, the refined coal used in Examples 2 to 5. This property-controlling coal had properties as given in items (3) to (6) for Comparative Example 2 in Table 2.

Comparative Examples 3 and 4 employed the refined coal as a property-controlling coal starting material and yielded property-controlling coals having properties as given in items (3) to (6) for Comparative Examples 3 and 4 in Table 2. The property-controlling coals employed or prepared in Comparative Examples 1 to 4 underwent classification through a sieve having an opening of 10 mm and had a maximum particle size less than 10 mm.

In Comparative Examples 1 to 4, each of the property-controlling coals was added to the refined coal (one used in Examples 1 to 5) and yielded a briquetting feedstock containing the property-controlling coal in a percentage based on the total mass of the resulting briquetting feedstock, where the percentage is given in item (2) for the comparative examples in Table 2.

In addition, a treatment was further performed as indicated in items (7) and (8) in Table 2. Specifically, the briquetting feedstock in Comparative Example 1 was further combined with a moistening coal in powder form (having a moisture content of 50 mass percent) in an amount of 8.0 mass percent based on the total mass of the resulting briquetting feedstock including the moistening coal. The briquetting feedstocks in Comparative Examples 2 to 4 were each further combined with water for moistening in an amount of 6.0 mass percent based on the total mass of the resulting briquetting feedstock including the water.

Next, in Comparative Example 1, the briquetting feedstock added and mixed with the moistening coal was briquetted under pressure using the double-roll briquetter and yielded a briquetted solid fuel in briquette form. In Comparative Examples 2 to 4, the briquetting feedstocks added and mixed with the water for moistening were briquetted under pressure using the double-roll briquetter and yielded briquetted solid fuels in briquette form.

The briquetted solid fuels were prepared in Comparative Examples 1 to 4 each at two or more different numbers of revolutions of the double-roll briquetter rolls. The briquetted solid fuels obtained at the different numbers of revolutions were individually examined to measure a crushing strength and a moisture content. The production rate at high strength, the crushing strength at that production rate, and the moisture content of the briquetted solid fuels are indicated in items (x) to (z) for the comparative examples in Table 2, as in the examples.

TABLE 1

| Items | Specified conditions | Example 1 | Example 2 | Example 3 | Example 4 | Example 5 |
|---|---|---|---|---|---|---|
| (1) Property-controlling coal starting material | | Low-rank coal | Refined coal | Refined coal | Refined coal | Refined coal |
| (2) Blending percentage (mass percent) | 5 to 70 | 16 | 30 | 20 | 30 | 30 |
| (3) Loose bulk density P (kg/L) | 0.6 or more | 0.67 | 0.72 | 0.72 | 0.80 | 0.66 |
| (4) Angle of repose A (degree) | 40 or less | 34 | 32 | 32 | 28 | 32 |
| (5) Average particle size $D_{50}$ (mm) | 0.3 to 2.0 | 0.75 | 0.81 | 0.81 | 2.40 | 0.72 |
| (6) Particle size distribution $W_{2.0}$ (mass percent) | 5 to 50 | 10.8 | 12.2 | 12.2 | 58.0 | 10.1 |
| (7) Moisture source to be added | | Coal | Water | Water | Water | — |
| (8) Amount of moisture source (mass percent) | | 8.0 | 6.0 | 6.0 | 6.0 | — |
| (x) Production rate at high strength (t/h) | | 1.16 | 1.42 | 1.22 | 1.42 | 1.12 |
| (y) Crushing strength at the production rate (kgf) | | 109 | 116 | 102 | 72 | 61 |
| (z) Moisture content (mass percent) | 3 to 10 | 6.2 | 6.8 | 6.9 | 6.7 | 2.4 |

Note 1:
Items (1) to (6) relate to property-controlling coals.
Items (x) to (z) relate to briquetted solid fuels.
Note 2:
1 kgf = 9.807 N

TABLE 2

| Items | Specified conditions | Comparative example 1 | Comparative example 2 | Comparative example 3 | Comparative example 4 |
|---|---|---|---|---|---|
| (1) Property-controlling coal starting material | | Low-rank coal | Refined coal | Refined coal | Refined coal |
| (2) Blending percentage (mass percent) | 5 to 70 | 16 | 30 | 1 | 90 |
| (3) Loose bulk density P (kg/L) | 0.6 or more | 0.52 | 0.45 | 0.66 | 0.67 |
| (4) Angle of repose A (degree) | 40 or less | 48 | 52 | 32 | 34 |
| (5) Average particle size $D_{50}$ (mm) | 0.3 to 2.0 | 0.22 | 0.20 | 0.75 | 0.78 |
| (6) Particle size distribution $W_{2.0}$ (mass percent) | 5 to 50 | 0.8 | 1.5 | 11.0 | 12.0 |
| (7) Moisture source to be added | | Coal | Water | Water | Water |
| (8) Amount of moisture source (mass percent) | | 8.0 | 6.0 | 6.0 | 6.0 |

TABLE 2-continued

| Items | Specified conditions | Comparative example 1 | Comparative example 2 | Comparative example 3 | Comparative example 4 |
|---|---|---|---|---|---|
| (x) Production rate at high strength (t/h) | | 0.48 | 0.36 | 0.24 | 1.20 |
| (y) Crushing strength at the production rate (kgf) | | 99 | 72 | 80 | 45 |
| (z) Moisture content (mass percent) | 3 to 10 | 6.4 | 6.1 | 6.0 | 5.9 |

Note 1:
Items (1) to (6) relate to property-controlling coals.
Items (x) to (z) relate to briquetted solid fuels.
Note 2:
1 kgf ≈ 9.807 N Results of Examples 1 to 5 will be described with reference to Table 1.

Examples 1 to 3 were samples meeting conditions specified in the present invention. As indicated in Table 1, Examples 1 to 3 gave briquetted solid fuels having good crushing strengths (100 kgf (980 N) or more) with good production rates (1.1 t/h or more).

Of Examples 1 to 3, Examples 2 and 3 are particularly preferred from the point typically of production rate. Comparative Example 3 as described below was a sample using approximately the refined coal alone as a briquetting feedstock, where the refined coal had been obtained in the drying unit 5. For example, Example 2 offered a solid fuel having a crushing strength about 1.5 times as much as the crushing strength of Comparative Example 3; and a production rate about 5.9 times as much as the production rate of Comparative Example 3.

Example 4 was a sample having, as properties of the property-controlling coal, an average particle size $D_{50}$ and a particle size distribution $W_{2.0}$ both out of conditions recommended in the present invention. Specifically, Example 4 employed the property-controlling coal including somewhat coarse particles. Example 4 thereby offered a considerably inferior crushing strength of the briquetted solid fuel as compared with Examples 2 and 3.

Example 5 employed a briquetting feedstock (having a moisture content of approximately equal to 0 mass percent) not added with water source for moistening. Example 5 underwent abrupt moisture absorption after briquetting and gave a briquetted solid fuel having a lower crushing strength that was significantly inferior as compared with Examples 2 and 3. Example 5 had a moisture content of the briquetted solid fuel out of the condition recommended in the present invention.

Results of Comparative Examples 1 to 4 will be described with reference to Table 2.

Comparative Example 1 employed, as the property-controlling coal, the low-rank coal as intact without property control. The property-controlling coal used in Comparative Example 1 included excessively fine particles and had, as properties, a loose bulk density P and an angle of repose A both out of the conditions specified in the present invention. Comparative Example 1 therefore gave a briquetted solid fuel with a significantly inferior production rate as compared with Examples 2 and 3, as indicated in item (x) in Table 2.

Comparative Example 2 employed, as the property-controlling coal, the refined coal as intact without property control. The property-controlling coal used in the Comparative Example 2 included excessively fine particles and thereby had, as properties, a loose bulk density P and an angle of repose A both out of the conditions specified in the present invention. Comparative Example 1 thereby gave a briquetted solid fuel with a significantly inferior production rate having a significantly inferior crushing strength at that production rate as compared with Examples 2 and 3, as indicated in items (x) and (y) in Table 2.

Comparative Example 3 employed a briquetting feedstock containing the property-controlling coal in an excessively small proportion out of the condition specified in the present invention, where the proportion was relative to the refined coal. Comparative Example 3 thereby gave a briquetted solid fuel with a particularly significantly inferior production rate as compared with Examples 2 and 3. Comparative Example 4 employed a briquetting feedstock containing the property-controlling coal in an excessively large proportion out of the condition specified in the present invention, where the proportion was relative to the refined coal. Comparative Example 4 thereby gave a briquetted solid fuel having a significantly inferior crushing strength as compared with Examples 2 and 3.

While the present invention has been particularly described with reference to specific embodiments thereof, it is obvious to those skilled in the art that various changes and modifications may be made without departing from the spirit and scope of the present invention. The present application is based on Japanese Patent Application No. 2013-091395 filed on Apr. 24, 2013, the entire contents of which are incorporated herein by reference.

INDUSTRIAL APPLICABILITY

The present invention is suitably applicable to the production of briquetted solid fuels from low-rank coals such as lignite and subbituminous coal.

REFERENCE SIGNS LIST

1 pulverizing unit
2 mixing unit
3 dewatering unit
4 solid-liquid separating unit
5 drying unit
6 property-controlling unit
7 briquetting unit
100 briquetted solid fuel production equipment

The invention claimed is:

1. A method for producing a briquetted solid fuel, the method comprising the steps of:

pulverizing a low-rank coal to give a pulverized low-rank coal;

mixing the pulverized low-rank coal with a solvent oil to give a slurry;

heating and thereby dewatering the slurry to give a dewatered slurry;

separating the solvent oil from the dewatered slurry by liquid-solid separation to give a cake;

heating and thereby drying the cake to further separate the solvent from the cake to thereby give a refined coal in powder form;

blending the refined coal with a property-controlling coal in powder form to control a property of the refined coal to thereby give a briquetting feedstock comprising the property-controlling coal in an amount of 5 to 70 mass percent based on the total mass of the briquetting feedstock, the property-controlling coal having, as properties, a loose bulk density of 0.6 kg/L or more and an angle of repose of 40° or less; and briquetting the briquetting feedstock under pressure to give the briquetted solid fuel in briquette form.

2. The method for producing a briquetted solid fuel according to claim 1, wherein the property-controlling coal further has, as properties, an average particle size of 0.3 to 2.0 mm and such a particle size distribution that a percentage of particles each having a particle size of 2 mm or more is 5 to 50 mass percent based on the total mass of the property-controlling coal.

3. The method for producing a briquetted solid fuel according to claim 1, wherein the property-controlling coal comprises at least one selected from the group consisting of:

a coal prepared by controlling the particle size of the low-rank coal;

a coal prepared by pulverizing the low-rank coal and granulating the pulverized low-rank-coal; and a coal prepared by briquetting the refined coal under pressure to give a briquetted coal, pulverizing the briquetted coal to give a pulverized coal, and controlling a particle size of the pulverized coal.

4. The method for producing a briquetted solid fuel according to claim 1, further comprising adding at least one of water and a moistening coal to the briquetting feedstock so that the briquetted solid fuel after briquetting has a moisture content of from 3 to 10 mass percent.

5. The method for producing a briquetted solid fuel according to claim 2, wherein the property-controlling coal comprises at least one selected from the group consisting of:

a coal prepared by controlling the particle size of the low-rank coal;

a coal prepared by pulverizing the low-rank coal and granulating the pulverized low-rank-coal; and a coal prepared by briquetting the refined coal under pressure to give a briquetted coal, pulverizing the briquetted coal to give a pulverized coal, and controlling a particle size of the pulverized coal.

* * * * *